US009878195B2

(12) United States Patent
Dugan

(10) Patent No.: US 9,878,195 B2
(45) Date of Patent: Jan. 30, 2018

(54) RESISTANCE TRAINING DEVICE

(71) Applicant: Darren Dugan, Naples, FL (US)

(72) Inventor: Darren Dugan, Naples, FL (US)

( * ) Notice: Subject to any disclaimer, the term of this patent is extended or adjusted under 35 U.S.C. 154(b) by 0 days.

(21) Appl. No.: 15/191,742

(22) Filed: Jun. 24, 2016

(65) Prior Publication Data

US 2017/0368402 A1 Dec. 28, 2017

(51) Int. Cl.
*A63B 21/00* (2006.01)
*A63B 21/062* (2006.01)
*A63B 23/02* (2006.01)

(52) U.S. Cl.
CPC .... *A63B 21/0632* (2015.10); *A63B 21/00065* (2013.01); *A63B 21/063* (2015.10); *A63B 21/154* (2013.01); *A63B 21/4029* (2015.10); *A63B 21/4047* (2015.10); *A63B 23/0233* (2013.01)

(58) Field of Classification Search
CPC .... A63B 21/06–21/0632; A63B 23/12–23/129
See application file for complete search history.

(56) References Cited

U.S. PATENT DOCUMENTS 4,757,992 A * 7/1988 Heitsch ..... A63B 23/1245 482/100
4,840,373 A * 6/1989 Maag ..... A63B 21/0615 482/100
D330,238 S 10/1992 Desiderio
5,421,796 A 6/1995 Jones et al.
5,964,684 A 10/1999 Sokol
6,726,609 B2 4/2004 Kuo
6,913,565 B2 7/2005 Mitchell et al.
7,658,701 B2 2/2010 Webb et al.
8,337,371 B2 12/2012 Vollmer, Jr.
2005/0096197 A1* 5/2005 Webber ..... A63B 23/03525 482/94
2009/0209396 A1 8/2009 Ferguson
2015/0148204 A1 5/2015 Sleppy

FOREIGN PATENT DOCUMENTS

WO WO2007079370 7/2007

* cited by examiner

*Primary Examiner* — Loan H Thanh
*Assistant Examiner* — Jennifer M Deichl

(57) ABSTRACT

A resistance training device for hands-free exercising of the back and shoulders includes a frame. A bench is coupled to the frame and is configured to seat a user. A backrest is coupled to the frame proximate to a rear edge of the bench. A pair of arms is pivotally coupled singly to opposing side supports of the frame. A resistor is operationally coupled to the pair of arms. The arms are positioned on the frame such that the arms are configured to abut elbows of the user seated on the bench. The resistor is positioned to resist the user's effort to pivot the arms relative to the frame, thus exercising the back and shoulders of the user without use of the user's hands.

16 Claims, 5 Drawing Sheets

RESISTANCE TRAINING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to training devices and more particularly pertains to a new training device for hands-free exercising of the back and shoulders.

BRIEF SUMMARY OF THE INVENTION

An embodiment of the disclosure meets the needs presented above by generally comprising a frame. A bench is coupled to the frame and is configured to seat a user. A backrest is coupled to the frame proximate to a rear edge of the bench. A pair of arms is pivotally coupled singly to opposing side supports of the frame. A resistor is operationally coupled to the pair of arms. The arms are positioned on the frame such that the arms are configured to abut elbows of the user seated on the bench. The resistor is positioned to resist the user's effort to pivot the arms relative to the frame, thus exercising the back and shoulders of the user without use of the user's hands.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
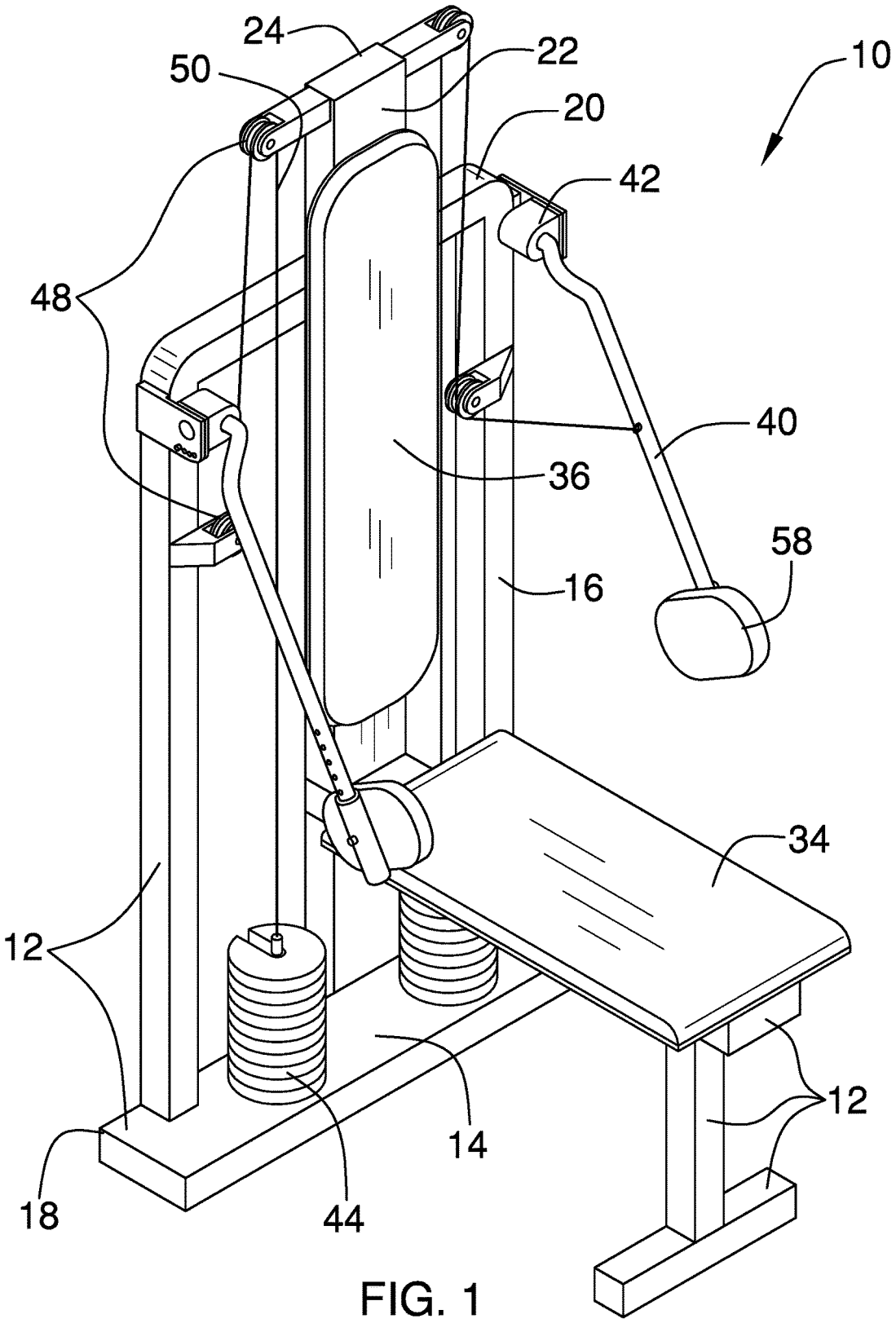
FIG. 1 is an isometric perspective view of a resistance training device according to an embodiment of the disclosure.
Figure 2:
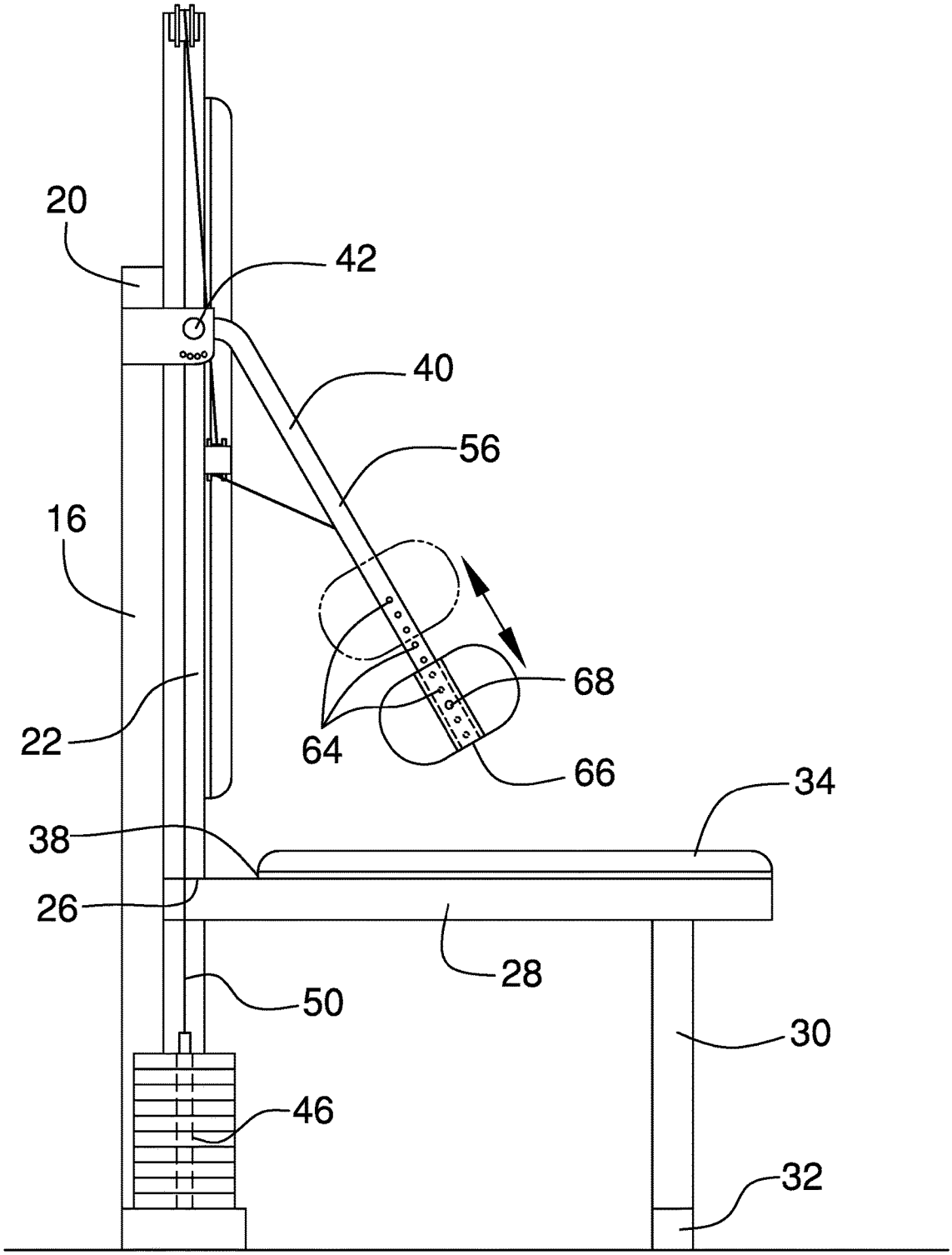
FIG. 2 is a side view of an embodiment of the disclosure.
Figure 3:
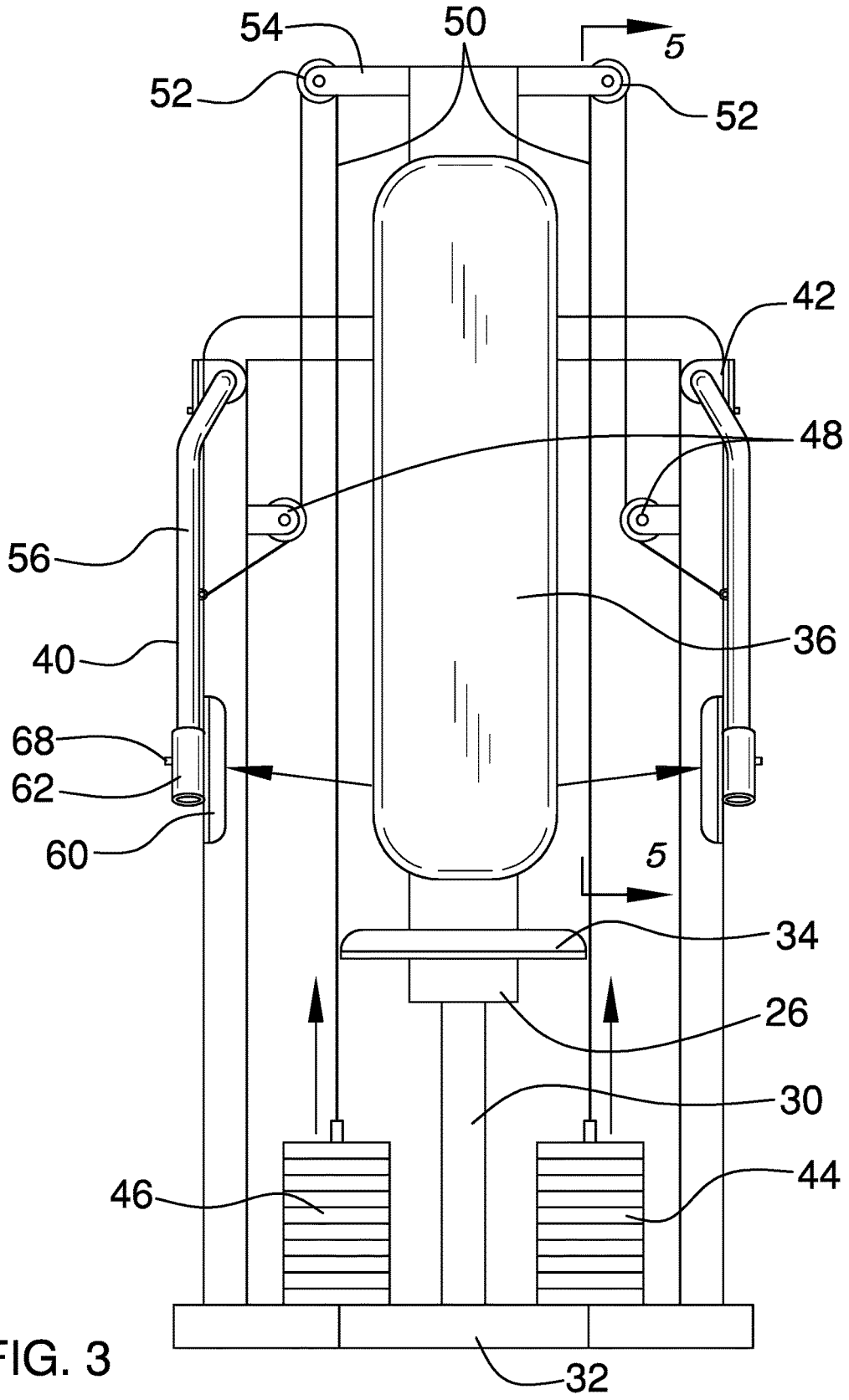
FIG. 3 is a front view of an embodiment of the disclosure.
Figure 4:
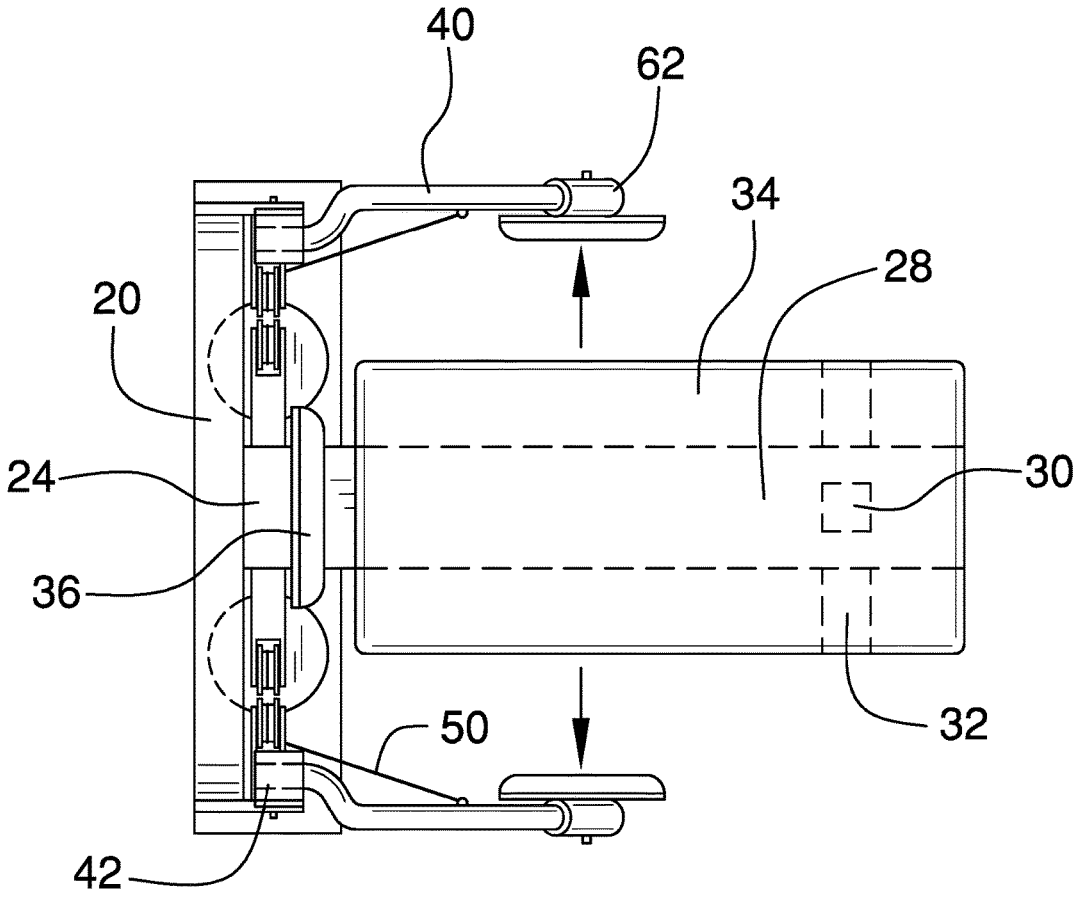
FIG. 4 is a top view of an embodiment of the disclosure.
Figure 5:
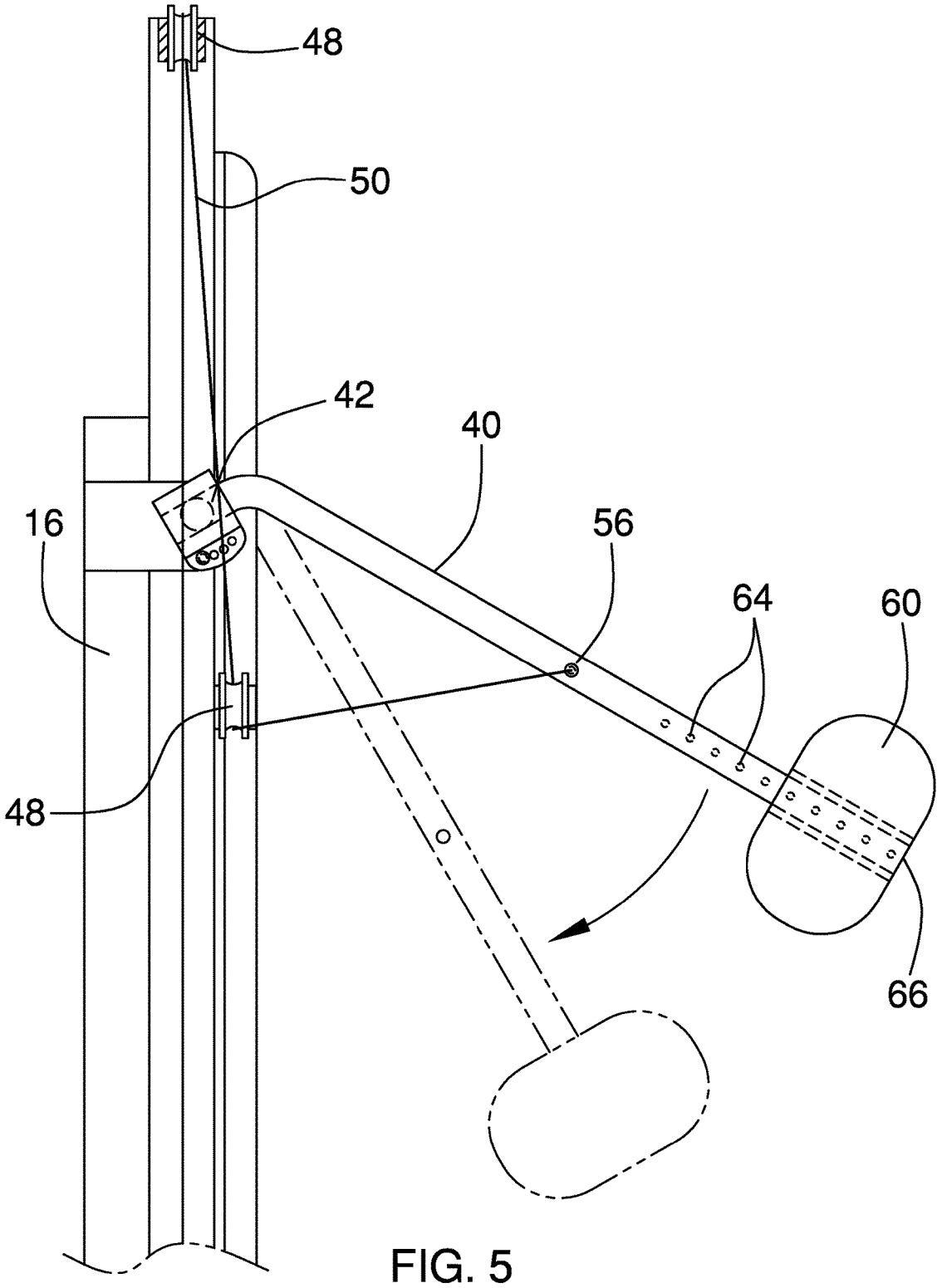
FIG. 5 is a cross-sectional view of an embodiment of the disclosure.

With reference now to the drawings, and in particular to FIGS. 1 through 5 thereof, a new training device embodying the principles and concepts of an embodiment of the disclosure and generally designated by the reference numeral 10 will be described.

As best illustrated in FIGS. 1 through 5, the resistance training device 10 generally comprises a frame 12. The frame 12 comprises a base 14. Opposing side supports 16 are coupled to and extend vertically from the base 14. In one embodiment, the side supports 16 are positioned singly proximate to back corners 18 of the base 14. A top bar 20 is coupled to and extends between the opposing side supports 16 distal from the base 14. A beam 22 is coupled to and extends perpendicularly from the top bar 20. A top end 24 of the beam 22 extends above the top bar 20 and a bottom end 26 of the beam 22 extends below the top bar 20. The beam 22 is positioned equally distant from the opposing side supports 16.

A lateral 28 is coupled to and extends substantially perpendicularly from the beam 22 proximate to the bottom end 26. A vertical 30 is coupled to the lateral 28 distal from the bottom end 26. The vertical 30 is positioned on the lateral 28 such that the vertical 30 is configured to buttress the lateral 28 in a substantially horizontal position relative to a surface upon which the frame 12 is positioned. A stabilizer 32 is coupled to the vertical 30 distal from the lateral 28.

A bench 34 is coupled to the frame 12 and is configured to seat a user. The bench 34 is coupled to the lateral 28 of the frame 12. In one embodiment, the bench 34 is substantially rectangularly shaped. In another embodiment, the bench 34 is padded.

A backrest 36 is coupled to the frame 12 proximate to a rear edge 38 of the bench 34. The backrest 36 is coupled to the beam 22. In one embodiment, the backrest 36 is substantially rectangularly shaped. In another embodiment, the backrest 36 is padded.

A pair of arms 40 is pivotally coupled singly to the opposing side supports 16 of the frame 12. The arms 40 are positioned proximate to the top bar 20. Each arm 40 comprises an adjuster 42 that is coupled to a respective opposing side support 16. The adjuster 42 is configured to selectively retain an associated arm 40 at a fixed angle relative to the respective opposing side support 16. In one embodiment, the adjuster 42 is configured to retain the associated arm 40 at fifteen, thirty, forty five and sixty degrees relative to the respective opposing side support 16.

A resistor 44 is operationally coupled to the pair of arms 40. In one embodiment, the resistor 44 comprises a plurality of plates 46. The plates 46 are selectively couplable to the arms 40. The plates 46 are configured to provide a level of resistance selectable by the user.

The resistor 44 also comprises a plurality of pulleys 48 and a pair of cables 50. The pulleys 48 are coupled to the frame 12. Each cable 50 is coupled to and extends between a respective arm 40 and the plurality of plates 46. Each cable 50 is operationally coupled to associated pulleys 48. The cables 50 are coupled to the pulleys 48 and the plurality of plates 46 such that the cables 50 are positioned to selectively resist pivoting of the arms 40 relative to the frame 12. In one embodiment, the plurality of pulleys 48 comprises pulleys 48 positioned singly on the opposing side supports 16, and pulleys 48 positioned singly on opposing ends 52 of a crossbar 54 that is coupled to the top end 24 of the beam 22. Each cable 50 is coupled to an associated arm 40 proximate to a midpoint 56 of the associated arm 40.

A pair of pads 58 is coupled singly to each arm 40. The pads 58 are positioned on the arms 40 such that the pads 58 are configured to abut elbows of the user seated on the bench 34. In one embodiment, each pad 58 is slidably couplable to a respective arm 40, such that each pad 58 is variably positionable on the respective arm 40. Each pad 58 comprises a cushion 60 that is coupled to a tube 62. The tube 62 is complementary to the arm 40. The arm 40 is configured to insert into the tube 62. Each arm 40 comprises a plurality of penetrations 64. The penetrations 64 extend from an end 66 of the arm 40 toward the midpoint 56 of the arm 40. Each tube 62 comprises a spring pin 68. The spring pin 68 is complementary to the penetrations 64. Each penetration 64 of the arm 40 is positioned for insertion of the spring pin 68, such that the pad 58 is selectively positionable on the arm 40.

In use, the arms 40 are positioned on the frame 12 such that the pads 58 are configured to abut the elbows of the user seated on the bench 34. The cables 50 are coupled to the pulleys 48 and the plurality of plates 46 such that the cables 50 are positioned to selectively resist pivoting of the arms 40 relative to the frame 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A resistance training device comprising:

a frame;

a bench coupled to said frame and configured for seating of a user;

a backrest coupled to said frame proximate to a rear edge of said bench;

a pair of arms pivotally coupled singly to opposing side supports of said frame;

a resistor operationally coupled to said pair of arms;

wherein said arms are positioned on said frame such that said arms are configured for abutment of elbows of the user seated on said bench, such that said resistor is positioned to resist the user's effort to pivot said arms relative to said frame; and said frame comprising a base, said opposing side supports being coupled to and extending vertically from said base, a top bar coupled to and extending between said opposing side supports distal from said base, a beam coupled to and extending perpendicularly from said top bar, such that a top end of said beam extends above said top bar and a bottom end of said beam extends below said top bar, said beam being positioned equally distant from said opposing side supports, a lateral coupled to and extending substantially perpendicularly from said beam proximate to said bottom end, a vertical coupled to said lateral distal from said bottom end, wherein said vertical is positioned on said lateral such that said vertical is configured to buttress said lateral in a substantially horizontal position relative to a surface upon which said frame is positioned, and a stabilizer coupled to said vertical distal from said lateral.

2. The device of claim 1, further including said side supports being positioned singly proximate to back corners of said base.

3. The device of claim 1, further comprising:

said bench being coupled to said lateral of said frame; and said backrest being coupled to said beam.

4. The device of claim 1, further including said bench and said backrest being substantially rectangularly shaped.

5. The device of claim 1, further including said bench and said backrest being padded.

6. The device of claim 1, further including said arms being positioned proximate to said top bar.

7. The device of claim 6, further including each said arm comprising an adjuster coupled to a respective said opposing side support, said adjuster being configured to selectively retain an associated said arm at a fixed angle relative to said respective said opposing side support.

8. The device of claim 7, further including said adjuster being configured to retain an associated said arm at fifteen, thirty, forty five and sixty degrees relative to said respective said opposing side support.

9. The device of claim 1, further including said resistor comprising a plurality of plates, said plates being selectively couplable to said arms, wherein said plates are configured to provide a level of resistance selectable by the user.

10. The device of claim 9, further including said resistor comprising a plurality of pulleys and a pair of cables, said pulleys being coupled to said frame, each said cable being coupled to and extending between a respective said arm and said plurality of plates, each said cable being operationally coupled to associated said pulleys, wherein said cables are coupled to said pulleys and said plurality of plates such that said cables are positioned to selectively resist pivoting of said arms relative to said frame.

11. The device of claim 10, further comprising:

said plurality of pulleys comprising pulleys positioned singly on said opposing side supports; and said plurality of pulleys comprising pulleys positioned singly on opposing ends of a crossbar coupled to said top end of said beam.

12. The device of claim 11, further including each said cable being coupled to an associated said arm proximate to a midpoint of said associated said arm.

13. The device of claim 1, further including a pair of pads coupled singly to each said arm, wherein said pads are positioned on said arms such that said pads are configured for abutment of elbows of the user seated on said bench.

14. The device of claim 13, further including each said pad being slidably couplable to a respective said arm, wherein each said pad is variably positionable on said respective said arm.

15. The device of claim 14, further comprising:

each said pad comprising a cushion, said cushion being coupled to a tube, said tube being complementary to said arm, wherein said arm is configured for insertion into said tube;

each said arm comprising a plurality of penetrations, said penetrations extending from an end of said arm toward a midpoint of said arm;

each said tube comprising a spring pin, said spring pin being complementary to said penetrations; and wherein each said penetration of said arm is positioned for insertion of said spring pin, such that said pad is selectively positionable on said arm.

16. A resistance training device comprising:

a frame, said frame comprising:

a base, opposing side supports coupled to and extending vertically from said base, said side supports being positioned singly proximate to back corners of said base, a top bar coupled to and extending between said opposing side supports distal from said base, a beam coupled to and extending perpendicularly from said top bar, such that a top end of said beam extends above said top bar and a bottom end of said beam extends below said top bar, said beam being positioned equally distant from said opposing side supports, a lateral coupled to and extending substantially perpendicularly from said beam proximate to said bottom end, a vertical coupled to said lateral distal from said bottom end, wherein said vertical is positioned on said lateral such that said vertical is configured to buttress said lateral in a substantially horizontal position relative to a surface upon which said frame is positioned, and a stabilizer coupled to said vertical distal from said lateral;

a bench coupled to said frame and configured for seating of a user, said bench being coupled to said lateral of said frame, said bench being substantially rectangularly shaped, said bench being padded;

a backrest coupled to said frame proximate to a rear edge of said bench, said backrest being coupled to said beam, said backrest being substantially rectangularly shaped, said backrest being padded;

a pair of arms pivotally coupled singly to said opposing side supports of said frame, said arms being positioned proximate to said top bar, each said arm comprising an adjuster coupled to a respective said opposing side support, said adjuster being configured to selectively retain an associated said arm at a fixed angle relative to said respective said opposing side support, said adjuster being configured to retain an associated said arm at fifteen, thirty, forty five and sixty degrees relative to said respective said opposing side support;

a resistor operationally coupled to said pair of arms, said resistor comprising a plurality of plates, said plates being selectively couplable to said arms, wherein said plates are configured to provide a level of resistance selectable by the user, said resistor comprising a plurality of pulleys and a pair of cables, said pulleys being coupled to said frame, each said cable being coupled to and extending between a respective said arm and said plurality of plates, each said cable being operationally coupled to associated said pulleys, wherein said cables are coupled to said pulleys and said plurality of plates such that said cables are positioned to selectively resist pivoting of said arms relative to said frame, said plurality of pulleys comprising pulleys positioned singly on said opposing side supports, said plurality of pulleys comprising pulleys positioned singly on opposing ends of a crossbar coupled to said top end of said beam, each said cable being coupled to an associated said arm proximate to a midpoint of said associated said arm;

a pair of pads coupled singly to each said arm, wherein said pads are positioned on said arms such that said pads are configured for abutment of elbows of the user seated on said bench, each said pad being slidably couplable to a respective said arm, wherein each said pad is variably positionable on said respective said arm, each said pad comprising a cushion, said cushion being coupled to a tube, said tube being complementary to said arm, wherein said arm is configured for insertion into said tube;

each said arm comprising a plurality of penetrations, said penetrations extending from an end of said arm toward said midpoint of said arm;

each said tube comprising a spring pin, said spring pin being complementary to said penetrations, wherein each said penetration of said arm is positioned for insertion of said spring pin, such that said pad is selectively positionable on said arm; and wherein said arms are positioned on said frame such that said pads are configured for abutment of elbows of the user seated on said bench, wherein said cables are coupled to said pulleys and said plurality of plates such that said cables are positioned to selectively resist pivoting of said arms relative to said frame.

* * * * *